United States Patent [19]

Kovalick

[11] 3,934,695

[45] Jan. 27, 1976

[54] METHOD AND APPARATUS FOR ENHANCING AND MAINTAINING CHARACTER QUALITY IN THERMAL PRINTERS

[75] Inventor: Albert W. Kovalick, Santa Clara, Calif.

[73] Assignee: Hewlett-Packard Company, Palo Alto, Calif.

[22] Filed: Sept. 23, 1974

[21] Appl. No.: 508,111

[52] U.S. Cl. ..... 197/1 R; 178/94; 219/216; 346/76 R

[51] Int. Cl.[2] ..... B41M 5/26

[58] Field of Search..... 197/1 R; 178/94; 346/76 R, 346/74 EE, 74 ES; 219/216

[56] References Cited

UNITED STATES PATENTS

| | | | |
|---|---|---|---|
| 3,161,457 | 12/1964 | Schroeder et al. | 197/1 R X |
| 3,467,810 | 9/1969 | Cady, Jr. | 346/76 X |
| 3,509,980 | 5/1970 | Loughry et al. | 197/1 R |
| 3,512,158 | 5/1970 | Scarbrough | 346/76 R |
| 3,567,904 | 3/1971 | Carlsen | 219/216 |
| 3,577,137 | 5/1971 | Brennan, Jr. | 219/216 X |
| 3,725,898 | 4/1973 | Canton | 219/216 X |
| 3,754,278 | 8/1973 | Borden, Jr. | 346/76 R |
| 3,777,116 | 12/1973 | Brescia et al. | 219/216 |
| 3,792,481 | 2/1974 | Nagashima et al. | 346/76 R X |
| 3,845,850 | 11/1974 | Herr et al. | 219/216 X |

*Primary Examiner*—Paul E. Shapiro
*Attorney, Agent, or Firm*—F. David LaRiviere

[57] ABSTRACT

The quality of thermally printed characters is enhanced by controlling the time at which and the time for which power is applied to the resistive printing elements in a battery-operated moving-head thermal dot matrix printer. By sequentially strobing the elements in the pattern of the character to be formed as the print head moves across thermal sensitive paper, a high-quality slanted character is printed and parasitic losses are reduced. By inversely varying the time power is supplied to each dot as battery voltage varies, character quality is maintained and useful battery life is extended.

21 Claims, 12 Drawing Figures

Ⓐ END OF PRINTED LINE

Ⓑ START OF NEXT LINE TO BE PRINTED

Ⓒ CLEAR ALL 18 BITS OF SR605

Ⓓ START LOADING OF SR605 WITH NEW SLANT ONES

Ⓔ LEADING SLANT ONE OF SR605 AT BIT 17

METHOD AND APPARATUS FOR ENHANCING AND MAINTAINING CHARACTER QUALITY IN THERMAL PRINTERS

BACKGROUND OF THE INVENTION

Uniform clarity and contrast of printed characters, both as to media on which they are printed and as between individual characters, is important in the design of printers generally. In battery-operated thermal dot matrix printers, such character quality can vary from character-to-character and from time-to-time as a function of dot matrix configuration or battery voltage, respectively, or both.

Thermal printing techniques include use of a moving print head with seven resistive elements (i.e., "dots") deposited thereon in columnar configuration for generating concentrations of heat at the surface of thermally sensitive paper when power is applied thereto. Referring to FIG. 1*a*, characters are formed on the paper by selectively energizing dots 1 through 7 as printer head 10 moves across and in close proximity to the paper. Each character comprises a pattern of dots selected from a 5 × 7 dot matrix.

As shown in FIG. 1*a*, when a typical 7 dot thermal head such as shown in FIG. 1*b* prints an "8," a maximum of 4 dots on the head are energized at any one time (e.g. $t_1$ or $t_5$). All 7 dots are energized at time $t_2$ when the same head prints a "1". Parasitic losses, such as are produced by battery return lead and resistance, reduce the amount of power supplied to each dot as a function of the number of simultaneously energized dots. Thus, these losses increase as the number of simultaneously powered dots increase. Print contrast, therefore, is more uniform for an "8" than for a "1," since fewer dots are energized simultaneously when printing an "8." For good quality print, the dot contrast should be consistent from character-to-character irrespective of character dot pattern.

The amount of power delivered to the dots, hence the amount of heat generated thereby, is a function of battery voltage. The more dots that the battery must power to print a character, the more the battery voltage decays. Battery voltage also decays simply as the energy stored therein is depleted with continued use. As battery voltage decays, printed character quality deteriorates because the dots generate heat nonuniformly from character-to-character. Therefore parasitic losses caused by battery resistance and connector and lead resistance should be minimized since they waste battery power which should be delivered to the printer head. These losses are significant where the printer is part of a hand-held calculator and the battery is small. However, in order to reduce battery resistance, typically a larger battery must be used. Connector and lead resistances cannot be further reduced without also sacrificing miniaturization, changing head geometry or greatly increasing cost of manufacture.

SUMMARY OF THE INVENTION

Therefore the present invention reduces parasitic losses while at the same time extending useful battery life and enhancing printed character quality by controlling the time at which and the time for which the dot is energized relative the movement of the print head. The time at which individual dots are energized is controlled by a slant generator comprising a circulating shift register and related control logic. The slant generator circuit sequentially strobes columnar-configured dots in the print head in the pattern of the character to be formed thus reducing the number of simultaneously energized dots. Since fewer dots are powered simultaneously, the instantaneous current from the battery and in the common return to the battery from each dot is less thereby reducing losses attributable to lead and battery resistances. The resultant character is slanted owing to the movement of the printer head.

The time for which the dot is energized is controlled by a variable duty cycle generator comprising a capacitor charging circuit and a comparator. By inversely varying the duty cycle of the signal applied to the dots as the magnitude of the battery voltage varies, the temperature each dot attains when energized is essentially the same for a greater range of battery voltage. Thus, substantially uniform print quality is assured for a greater variation of battery voltage.

The combination of the two control circuits provides substantially uniform quality of printed characters and improves the efficiency of the thermal printer head subsystem by supplying more useful power to the printer head dots, and extends useful battery life by compensating for variations in battery voltage.

DESCRIPTION OF THE PREFERRED EMBODIMENT

Figure 1B:
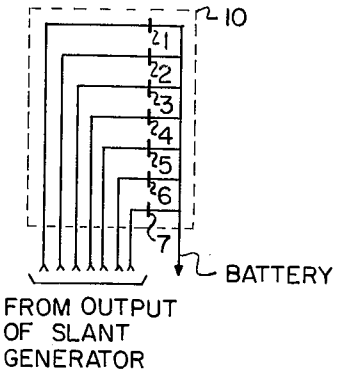
FIG. 1*b* is a block diagram of a typical 7 dot thermal moving print head.
Figure 1A:
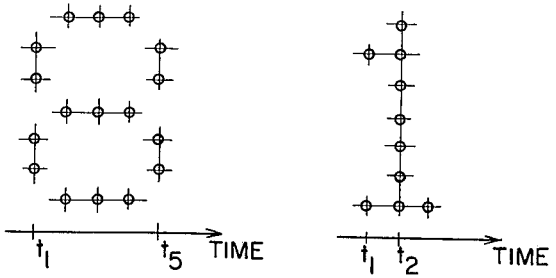
FIG. 1*a* illustrates a typical prior art character printed in a 5 × 7 dot matrix by a typical moving head thermal printer.
Figure 2C:
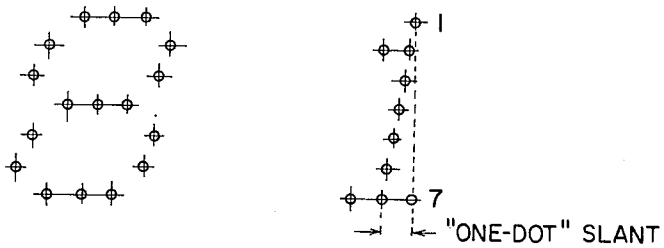
FIG. 2*c* illustrates a character printed in a 5 × 7 dot matrix by a printer system including the slant generator of FIG. 2*a*.
Figure 2A:
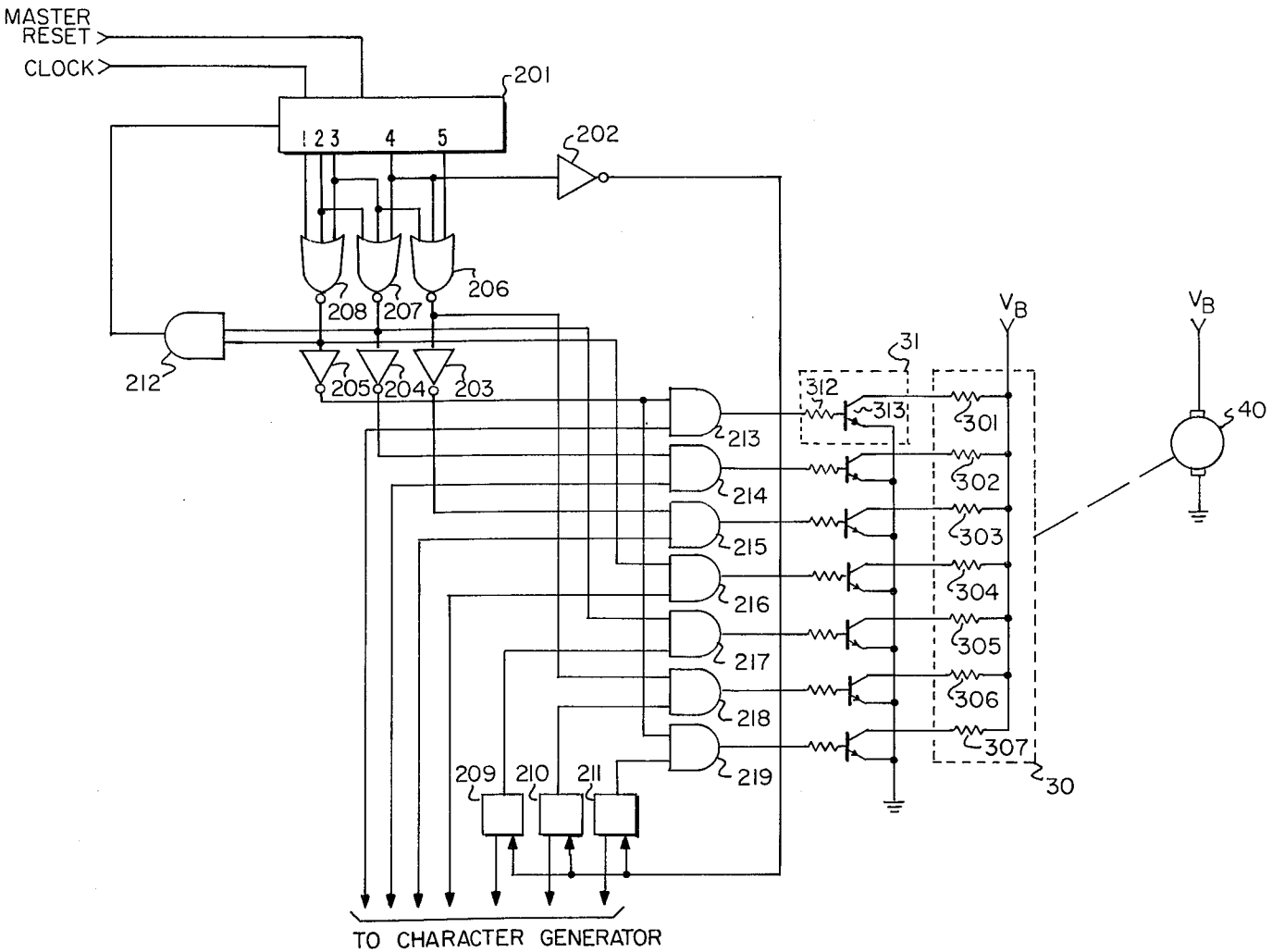
FIG. 2*a* is a logic diagram of a character slant generator constructed according to one embodiment of the present invention.
Figure 2B:
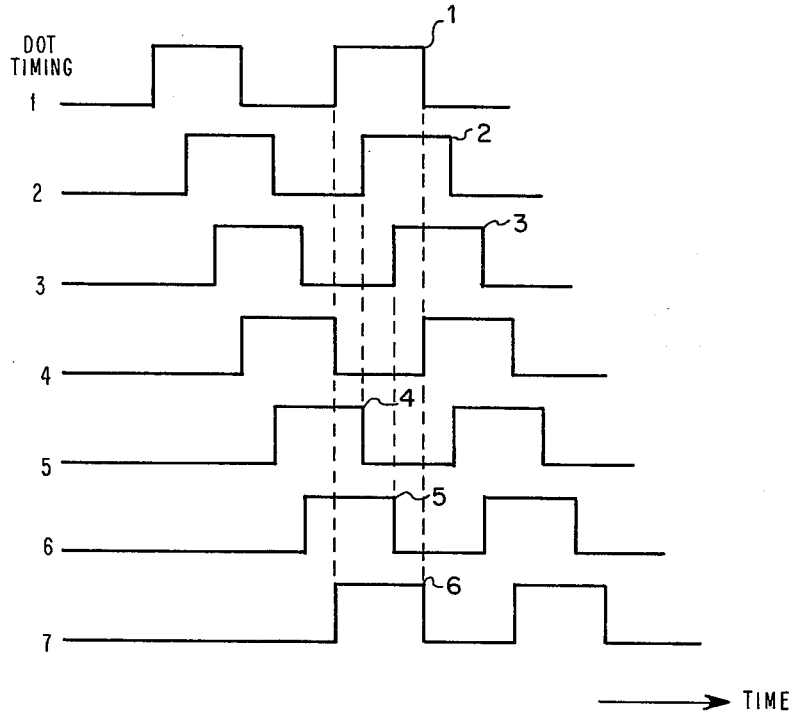
FIG. 2*b* is a timing diagram of power applied to print head dots in a printer using the slant generator of FIG. 2*a*.

Referring to FIG. 2*a*, one embodiment of a slant generator according to the present invention comprises clocked circulating shift register (SR) 201, inverters 202 through 205, NOR gates 206 through 208, flip-flops 209 through 211 and AND gates 212 through 219. SR 201 operates as a ring counter wherein a one shifts left to right each clock pulse for five clock pulses and is then fed back to a serial input. NOR gates 206 through 208 and inverters 202 through 205 encode the output signals from the output taps of SR 201 and the timing signals shown in FIG. 2*b* are obtained. These signals are then gated with dot matrix data from a read-only memory (ROM) through print command AND gates 213 through 219. The outputs therefrom form dot driver command signals which are applied to the input of the dot drivers. Note that one column of a character is printed for every circulation of SR 201. Thus, the circulation rate of SR 201, which is the same as the repetition rate of the output signals, coupled with the speed of the moving head, determines the interval between columns of a character.

For a one dot slant, the timing signals for dots 1 and 7 will coincide in time as shown in FIG. 2*b*. A more detailed description of the control of character slant is given later in this specification. Flip-flops 209 through 211 hold data on lines 5, 6 and 7 since printing of the next column data in the 5 × 7 (column x line) matrix begins before printing the present column data is finished. This overlap of column data is illustrated in FIG. 2*b* where signals, 1, 2 and 3 of the next dot column overlap with signals 4, 5 and 6 of the present dot column. Thus parts of more than 2 columns of dots in the matrix may be printing simultaneously.

FIG. 2*a* also shows the circuit schematics of each of seven identical dot drivers. Resistors 301, 302, 303, 304, 305, 306 and 307, represent the resistances of the dots located on printer head 30. Referring to dot driver 31, the base of transistor 313 is connected to base resistor 312, the collector is connected to resistor (i.e., dot) 301 and the emitter is grounded. Transistor 313 is selected for low $V_{CE}$ in saturation. When the output of one of the AND gates 212 through 219 (i.e., a dot driver command signal) is applied to the base of transistor 303 through resistor 312, transistor 313 saturates, and current is drawn through the dot which generates heat.

Figure 3:
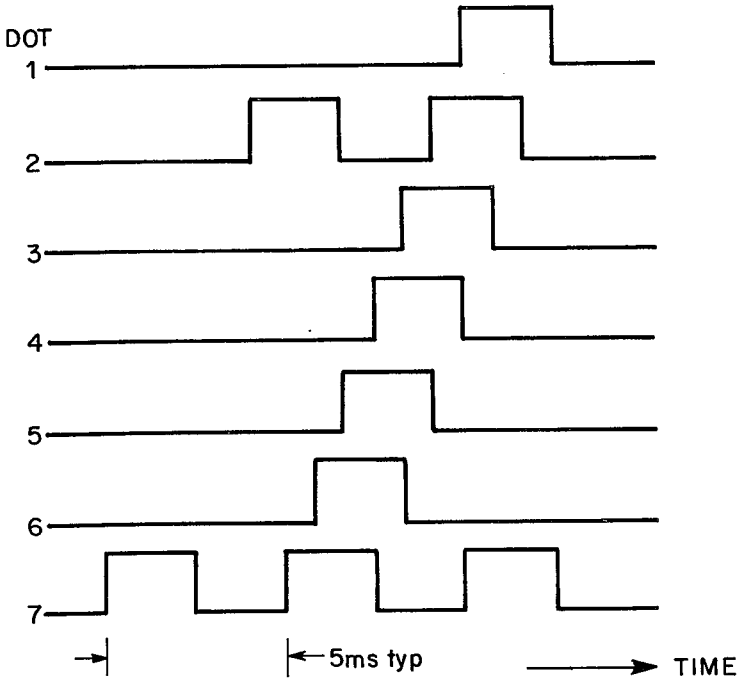
FIG. 3 is a timing diagram of the power applied to the print head dots to print the slanted character "one" of FIG. 2*c*.

In operation, the 7 dots are sequentially strobed from top to bottom (i.e., dots 1 through 7 respectively) according to the timing of the dot driver command signals shown in FIG. 2*b* in the pattern of the character to be formed as print head 30 on which they ride is driven across the paper by motor 40. The pattern of the character is determined by the character data from a character generator. Slanted characters are formed on the paper as shown in FIG. 2*c*. The timing of dot driver command signals to form the slanted character "1" of FIG. 2*c* is shown in FIG. 3. The timing of the command signal coupled with the speed of the moving head determines the "slant" of the character (refer to FIG. 2*c*). For a one-dot slant from top to bottom of the character (i.e., dots 1 and 7 vertically aligned) where the speed of the moving head is 1.33 inches/sec, the period of command signals is 5 milliseconds.

A one-dot slant was selected as a compromise between the resultant reduction in parasitic losses, the amount of logic circuitry necessary to achieve greater slant and the aesthetic appearance of the printed characters. For a one-dot slant, an average of less than 4 dots are energized at any one time. The instantaneous current in the common is thereby reduced with concomitant reduction in parasitic power losses. Since the instantaneous current from the battery is less, the voltage drop across the unavoidable battery resistance is also reduced. Hence, the voltage supplied by the battery to associated calculator electronics is affected less by printer operation as well.

Slanting of characters is also achievable by moving the paper across the print head or combining the movement of both relative to one another. The advantages of such slanting are achievable so long as there is some movement of print head relative to print media.

It should be noted that the character slant concept according to the present invention makes it feasible to package all seven dot driver transistors in one integrated circuit. As shown above without slanting all seven drivers could be energized simultaneously. The total instantaneous power necessarily dissipated by all seven drivers could cause a damaging increase of chip temperature. Reliability of such circuits is frequently a function of the temperature at which they are forced to operate. By slanting according to the present invention, the instantaneous power dissipated is substantially reduced, hence, the maximum chip temperature attained during operation is reduced and integrated circuit packaging is practical.

Figure 4:
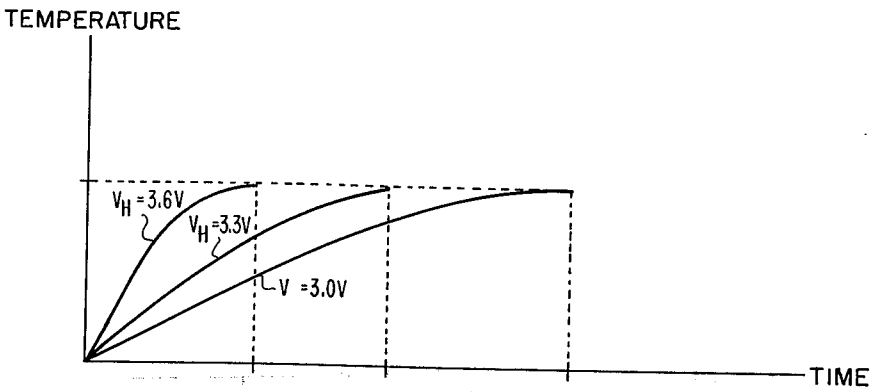
FIG. 4 compares the time typical print head dots require to attain the same operating temperature for different battery voltages.

The temperature attained by the dots in the head is proportional to the magnitude of applied voltage and the length of time that voltage is applied. As mentioned earlier uniformity of dot temperature from character-to-character is essential to uniform print quality. FIG. 4 shows that the same temperature may be reached with different battery voltages if, as the voltage decreases it is applied to the dot longer. Thus, by using duty cycle (DC) generator 500 shown in FIG. 5*a*, the voltage applied to the dot can be modulated in time as a function of the magnitude of the battery voltage available.

Figure 5A:
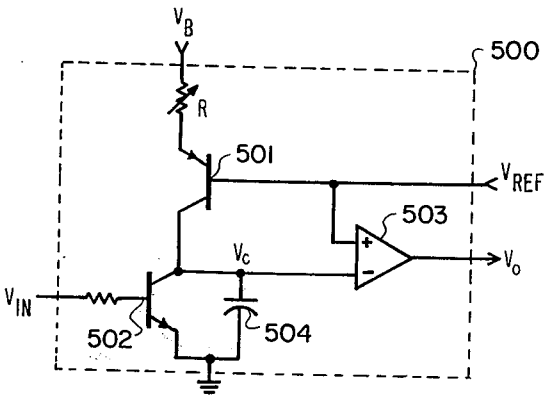
FIG. 5*a* is a circuit diagram of a duty cycle generator constructed according to the preferred embodiment of the present invention.
Figure 5B:
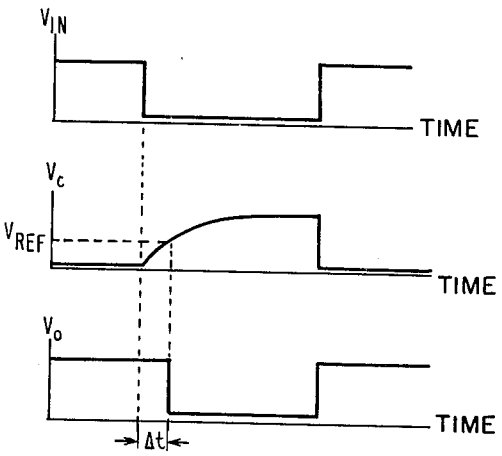
FIG. 5*b* is a timing diagram of the output voltage and the input voltage of the duty cycle generator of FIG. 5*a* compared with the voltage across capacitor 504 thereof.

Referring now to FIGS. 5*a* and 5*b*, since $C\Delta V = i\Delta t$, if capacitor 504 = $1 \times 10^{-6}$, $\Delta V = V_{REF}$, then $$i = V_B \frac{-(V_{REF} + 0.7)}{R} \text{ where } V_B \text{ is the battery voltage}$$

and 0.7 is the $V_{BE}$ of transistor 501. Therefore, $$\Delta t \frac{C \times V_{REF} \times R}{V_B - (V_{REF} + 0.7)} \quad (1)$$

where $\Delta t$, the time it takes capacitor 504 to charge to $V_{REF}$, represents the change in DC (i.e., on-time/off-time) of the command signal applied to the dot drivers. As will be shown later $\Delta t$ also represents the time during which a shift register similar to SR 201 is filled with ones.

For the preferred embodiment, the battery voltage $V_B$ varies from 3.3 V to 4.2 V, or a variation of approximately 27 percent. If the required value of $\Delta t$ were linearly proportional to the variation in $V_B$, then the base of transistor 501 could be grounded and $V_{REF}$ would control comparator 503 only. However, applying 3.3 V to the dot 27 percent than 4.2 V is inadequate additional time for the dot to reach the same temperature at the lower voltage extreme. Therefore the change in $V_B$ must produce a greater relative change in DC of power applied to the dots. A 50/50 DC is shown in FIG. 2*d* for a fixed dot drive period of 5 ms at nominal battery voltage. If a 75/25 DC is desirable at 3.4 V and a 45/55 DC is desirable at 4.15 V, the values of R and $V_{REF}$ in the variable DC generator of FIG. 5*a* can be determined from simultaneous solution of equation 1. Then, for a total DC period of 5 ms, $$0.75\ (5 \times 10^{-3} = \frac{1 \times 10^{-6} R \times V_{REF}}{3.4 - (V_{REF} + .7)},$$

and $$0.45\ (5 \times 10^{-3}) = \frac{1 \times 10^{-6} R \times V_{REF}}{4.15 - (V_{REF} + .7)}$$

or $$R = 2.65k \text{ and } V_{REF} = 1.58 \text{ volts.}$$

Using these values of R and $V_{REF}$, $$\Delta t(\text{in ms}) = \frac{4.187}{V_B - 2.28}.$$

Expressed as a percentage of total DC period, on-time is $$\Delta t\ (\text{in \% of 5 ms}) = \frac{8.37}{V_B - 2.28} \qquad (2)$$

Figure 5C:
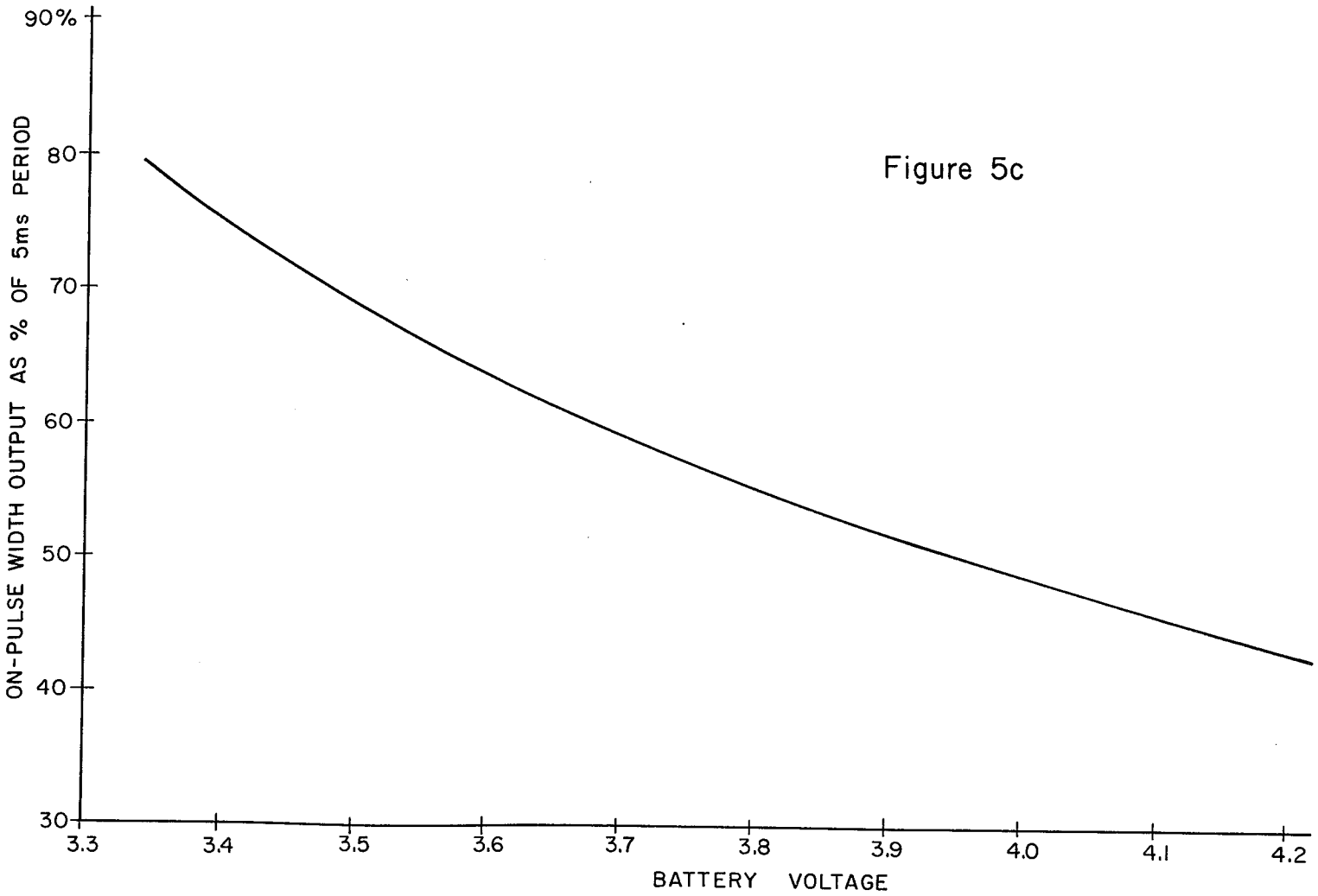
FIG. 5*c* is a curve showing the change of percentage ontime of the dot drive signal as a function of battery voltage.

Referring to FIG. 5*c*, at 3.5 V, for example, the DC generated is approximately 69/31 whereas at 4.0 V the DC is approximately 49/51.

Figure 6A:
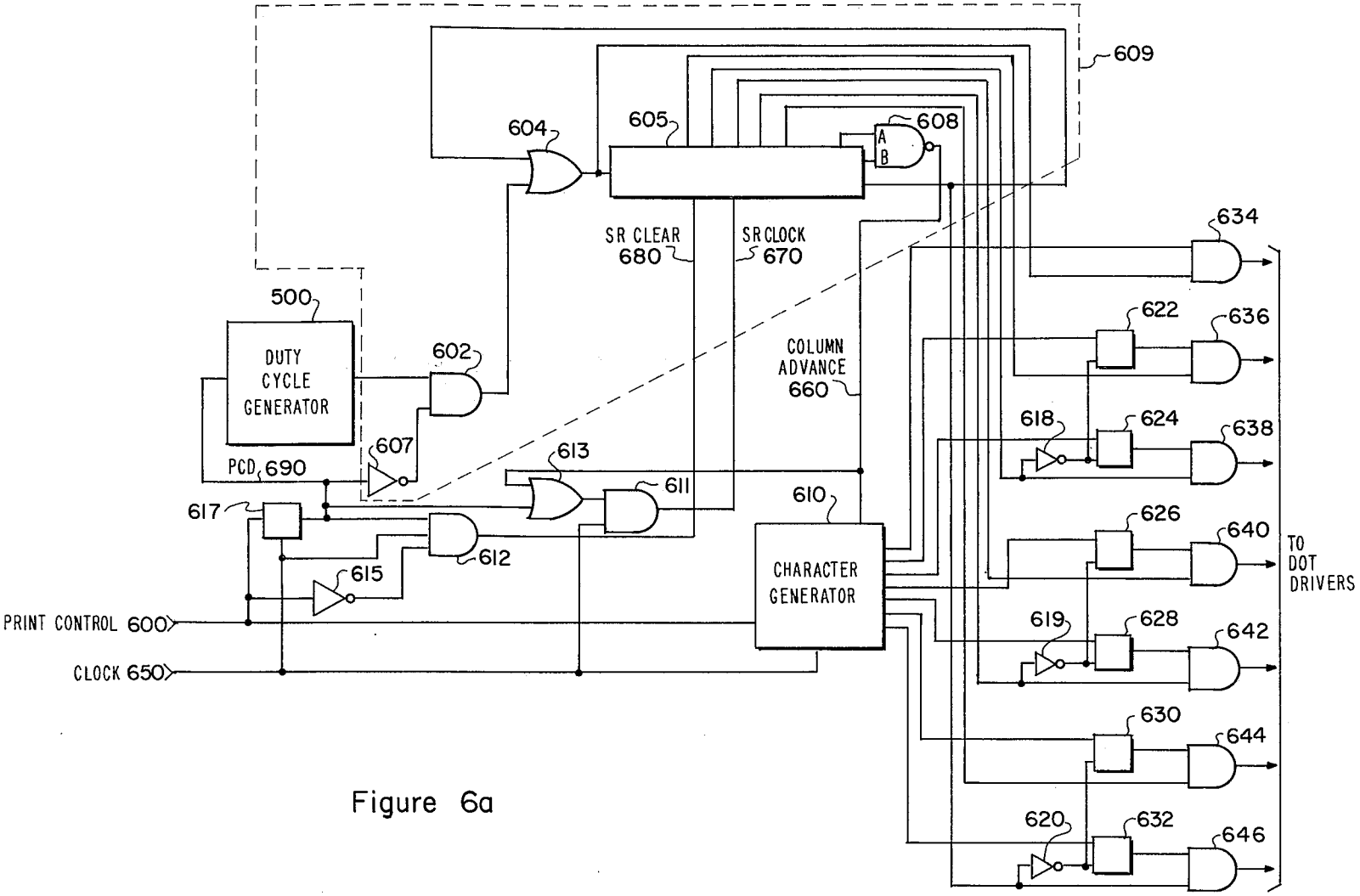
FIG. 6*a* is a logic diagram of a thermal printer system including character slant and duty cycle generators constructed according to the preferred embodiment of the present invention.

To combine the advantages of the slant generator and variable DC generator into one system, the contents of the slant generator SR are redetermined on a line-by-line basis by the variable DC generator. Referring now to FIG. 6*a*, the thermal printer system according to the preferred embodiment of the present invention includes character generator 610, variable DC generator 500 described above, character slant generator 609 similar to the one described above with interconnecting logic, and the command logic for the dot drivers also described above. Character generators are commonly available on the commercial market and provide the data necessary to select the appropriate dots to form a character within the 5 × 7 matrix format. Thus, the character generator can be, for example, the Signetics 2516 or equivalent.

Character slant generator 609 comprises 18-bit tapped shift register (SR) 605, AND gate 602, OR gate 604, inverter 607 and NAND gate 608. The delay elements of SR 605 can be a series of two Signetics 74164 and one Signetics 7474 or equivalent. While circulation of SR605 as observed at the output taps thereof provides the basic timing necessary to electrically slant the characters as the print head moves across the paper, the contents of SR 605 (i.e., the relative number of ones and zeroes) provides the DC modulation needed to electrically compensate for decaying battery voltage. Duty-cycle-modified, slant modulation data modulates character data via gates 634 through 646. The dot drivers are driven only when these gates are enabled. Since these gates are enabled if and only if ones appear at both inputs, even if a character data one is applied to one input, the dot drivers will be driven only for the time ones from SR 605 (referred to hereinafter as slant ones) appear at the other input. If SR 605 contains 9 slant ones and 9 zeroes, a 50/50 DC signal is sequentially received by the dot drivers. Thus, the DC of the signal applied to the dots is controlled by the number of slant ones circulating in SR 605 since that number determines the length of time gates 634 through 646 are enabled. The number of slant ones in SR 605 is determined prior to the printing of each line by the DC generator.

Referring again to FIG. 6*a*, slant ones are fed into SR 605 during the time it takes capacitor 504 in DC generator 500 to charge to a voltage equal to $V_{REF}$. When print control delayed (PCD) signal 690 is low, the output of DC generator 500 is high and SR 605 receives slant ones therefrom via gates 602 and 604. During this time, the print head dots cannot be energized. The supply of slant ones from DC generator 500 is terminated when capacitor 504 charges to a voltage equal to $V_{REF}$ and comparator 503 changes state. The charging time of capacitor 503 relative to the clock time of SR 605 is such that comparator 503 changes state before SR 605 is completely filled with slant ones (i.e., 18 one-bits). While SR 605 is filling with slant ones at the B input of gate 604, the A input thereof is low because the contents of SR 605 were cleared before PCD 690 switched low. SR 605 shifts its contents, which amount to at least 6 but less than 18 slant ones, until gate 608 switches low. When PCD 690 then switches high, the contents of SR 605 circulate and capacitor 504 in the DC generator discharges through transistor 502.

Figure 6B:
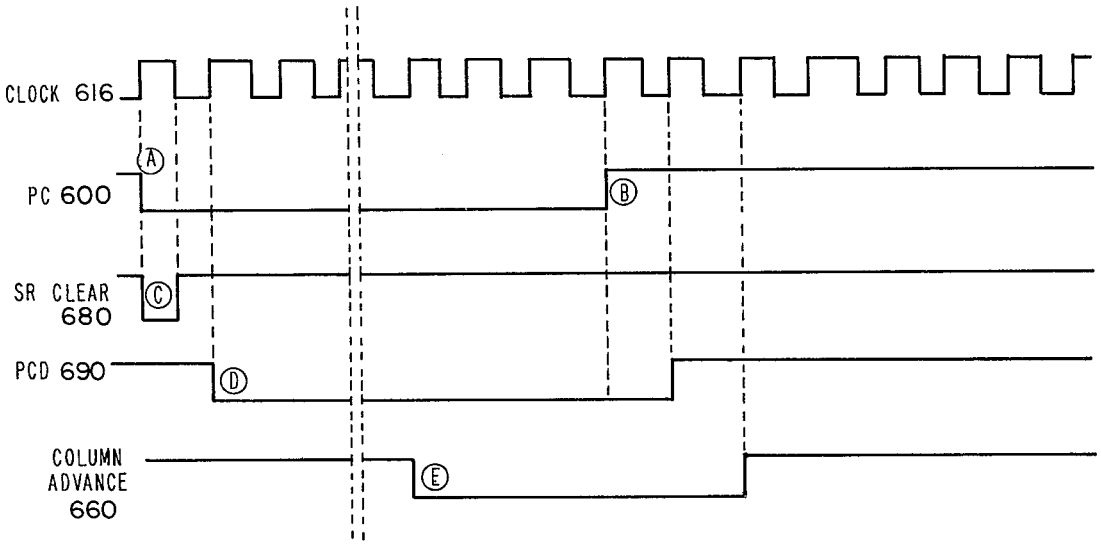
FIG. 6*b* is a timing diagram of control signals employed by the printer system of FIG. 6*a*.

Referring to FIG. 6*b*, column advance signal (CA) 660, the generation of which is detailed later in this specification, and PCD 690 are gated by OR gate 613 to produce a low output when the leading slant one circulating in SR 605 is at bit 17 (refer to E). When this occurs, SR clock signal 670 is disabled by gate 611 and SR 605 stops circulating. When the PCD signal 690 goes high, SR clock signal 670 is again applied to SR 605 and its contents circulate. By stopping circulation of SR 605 when the column advance signal 660 is low, the leading slant one in SR 605 is always known to be at bit 17. The location of the leading slant one is important since PC 600 is asynchronous. Since the leading slant one always starts from bit 17, vertical alignment of the first dot of the first character of all printed lines is assured. SR clear signal 680 clears the contents of SR 605 of all slant ones prior to determination of each new DC by DC generator 500.

The process of filling SR 605 with slant ones described above is repeated prior to the printing of each line. The output signals from the seven taps of SR 605 are the same as the signals shown in FIG. 2*d* if DC generator 500 fed 9 slant ones into SR 605. Of course DC generator 500 can provide variable DC from 30/70 to 90/10 as $V_B$ varies as shown in FIG. 5*c*. Note that, while output taps 1 and 7 of SR 605 are electrically the same, the signal at tap 7 is delayed 18 clock pulses from the signal at tap 1 wherein the signal at both taps includes the same number of slant ones and zeroes. This signal delay generates the printed character "slant" and the signal content of slant ones and zeroes determines to dot driver signal duty cycle.

To provide the timing necessary for printing each column of character data gate 608 generates a CA signal 608 only when bit 17 is a one and the complement of bit 18 is one. Signals representing these conditions are applied to inputs A and B, respectively of gate 608. The signal is used by character generator 610 and logic to know when the printer head has advanced to the next column on the character being printed. Gates 634 through 646 receive slant data from SR 605 and character data from character generator 610 via 622 through 632. These latches are necessary to preserve character data. Owing to the one-dot slant, the seventh dot of column 1 and the first dot of column 2 are printed at the same time. If the DC is long, for example, 70/30, then when the first dot of column 2 is starting to be printed, five dots (3–7) of column 1 are still printing. Since column 2 data needs to be present for its first dot to be energized, column 1 data must be held in latches 632 if a dot is being printed when column data changes.

As indicated above a new duty cycle is determined at the end of each printed line. Print control 600 signal can be generated from print head carriage contact logic, or other logic which synchronizes the relative movement of the printer head and paper with respect to completion or start of the printing of a line of characters.

I claim:

1. A printer for printing characters on a printing medium comprising:

a printer head, having a plurality of spaced transducers mounted in a line thereon, movably mounted in close proximity to the printing medium, the line of transducers being oriented transverse to the direction of head movement;

motive means coupled to the printer head for driving the printer head past the printing medium at a predetermined rate;

timing means for producing timing signals;

character generating means coupled to the timing means for generating character data signals in response to timing signals therefrom;

slant generating means coupled to the timing means for generating periodic, sequentially-timed command signals at a preselected repetition rate in response to timing signals received therefrom; and gating means coupled to the printer head, the slant generating and the character generating means for selectively activating successive ones of the transducers in response to command and character data signals to print characters on the printing medium as a matrix of rows and columns of dots, the interval between rows being determined by the spacing between transducers and the interval between columns being determined by the repetition rate of the command signals and the rate at which the printer head is driven.

2. A printer as in claim 1 wherein:

the printing medium produces a mark on the surface thereof in response to heat generated in close proximity thereto; and the transducers generate heat in response to an electrical signal applied thereto.

3. A printer as in claim 1 wherein the slant generating means includes a circulating shift register having a plurality of output ports for coupling command signals therefrom and first gating means coupled to the shift register for controlling the contents thereof.

4. A printer as in claim 1 powered by a battery wherein the slant generating means includes duty cycle generating means for controlling the period of the command signals generated thereby to activate the transducers to produce printed characters having uniform quality on the printing medium.

5. A printer as in claim 4 wherein:

the slant generating means includes a circulating shift register having a plurality of output ports; and the duty cycle generating means includes a capacitor and a capacitor charging circuit coupled to the battery for charging the capacitor to a voltage substantially equal to the voltage thereof, and having an output port for coupling an electrical signal representing the capacitor voltage therefrom; a comparator having an output port and at least two input ports, one of the input ports being coupled to a reference voltage representing the voltage required for the transducers to produce printed characters having uniform quality on the printing medium and the other of the input ports being coupled to the output port of the capacitor charging circuit, said comparator being effective for comparing the voltages applied to the input ports thereof and for providing a signal at the output port representing the time it takes the capacitor to charge to a voltage substantially equal to the reference voltage; and second gating means coupled to the comparator and to the shift register for controlling the contents thereof in response to the signal at the output port of the comparator, said contents being effective for controlling the period of the command signals.

6. A printer as in claim 5 wherein the time it takes the capacitor to charge to a voltage substantially equal to the reference voltage is approximately equal to the length of time the transducers must be activated at the battery voltage available to produce printed characters having uniform quality on the printing medium.

7. A printer as in claim 4 wherein the duty cycle generating means controls the period of the command signals inversely as a function of the battery voltage.

8. A printer as in claim 7 wherein the function of the battery voltage is substantially exponential.

9. A printer as in claim 4 wherein the command signals include an on-time and an off-time, said on-time being set by the duty cycle generating means as a function of the magnitude of the battery voltage and being effective for enabling activation of the transducers.

10. A printer as in claim 9 wherein the on-time of the command signals is an inverse function of the magnitude of the battery voltage.

11. A printer as in claim 4 wherein:

the slant generating means includes a circulating shift register having a plurality of output ports;

the duty cycle generator includes:

sampling means for determining the magnitude of the battery voltage;

comparator means coupled to the sampling means, for comparing the magnitude of the battery voltage with a reference voltage to determine the length of time the transducers must be activated at the magnitude of battery voltage available to produce printed characters having uniform quality on the printing medium; and gating means, coupled to the comparator means, for controlling the contents of the circulating shift register, said contents being effective for controlling the period of the command signals.

12. A printer as in claim 1 for printing slanted characters wherein the slant of the columns of the printed characters is determined by the sequential timing of the command signals and the rate at which the printer head is driven.

13. A method for printing characters on a printing medium comprising the steps of:

supplying power;

driving a printer head having a plurality of spaced transducers mounted in a line aligned thereon transverse to the direction of head movement past the printing medium in close proximity thereto and at a predetermined rate;

producing timing signals;

generating character data signals in response to the timing signals;

generating periodic, sequentially-timed command signals at a preselected repetition rate in response to the timing signals; and activating successive ones of the transducers selectively in response to command and character data signals to print characters on the printing medium as a matrix of rows and columns of dots, the interval between rows being determined by the spacing between transducers and the interval between columns being determined by the repetition rate of the command signals and the rate at which the printer head is driven.

14. A method as in claim 13 wherein:

the printing medium produces a mark on the surface thereof in response to heat generated in close proximity thereto; and the transducers generate heat in response to an electrical signal applied thereto.

15. A method as in claim 13 wherein the step of generating command signals includes coupling command signals from a circulating shift register having a plurality of output ports and controlling the contents thereof.

16. A method as in claim 13 wherein:

the step of supplying power comprises the step of supplying power from a battery; and the step of generating periodic, sequentially-timed command signals includes the step of controlling the period of the command signals to activate the transducers to produce printed characters having uniform quality on the printing medium.

17. A method as in claim 16 wherein:

the step of controlling the period of the command signals includes the step of controlling the contents of a circulating shift register having a plurality of output ports which comprises the steps of:

a. charging a capacitor to a voltage substantially equal to the voltage of the battery;

b. comparing the capacitor voltage with a reference voltage representing the voltage required for the transducers to produce printed characters having uniform quality on the printing medium;

c. providing a signal representing the time it takes the capacitor to charge to a voltage substantially equal to the reference voltage; and d. controlling the contents of the circulating shift register in response to the signal representing the time it takes the capacitor to charge to a voltage substantially equal to the reference voltage, said contents being effective for controlling the period of the command signals.

18. A method as in claim 16 wherein the step of controlling the period of the command signals includes controlling that period inversely as a function of the battery voltage.

19. A method as in claim 16 wherein the function of the battery voltage is substantially exponential.

20. A method as in claim 16 wherein:

the step of generating command signals includes coupling command signals from a circulating shift register having a plurality of output ports; and the step of controlling the period of the command signals includes the steps of:

determining the magnitude of the battery voltage;

comparing the magnitude of the battery voltage with a reference voltage to determine the length of time the transducers must be activated at the magnitude of battery voltage available to produce printed characters having uniform quality on the printing medium; and controlling the contents of the circulating shift register.

21. A method as in claim 13 for printing slanted characters wherein the slant of the columns of the printed characters is determined by the sequential timing of the command signals and the rate at which the printer head is driven.

* * * * *

UNITED STATES PATENT AND TRADEMARK OFFICE

CERTIFICATE OF CORRECTION

PATENT NO. : 3,934,695

DATED : January 27, 1976

INVENTOR(S) : Albert W. Kovalick

It is certified that error appears in the above-identified patent and that said Letters Patent are hereby corrected as shown below:

Col. 2, line 55, "ontime" should read -- on-time --;

Col. 4, line 31, after "decreases" insert a comma;

Col. 4, line 40, the formula should read:

$$i = \frac{V_B - (V_{REF} + 0.7)}{R}$$

Col. 5, line 23, in equation (2) "8.37" should read -- 83.7 --;

Col. 5, line 65, "tailly" should read -- tially --.

Signed and Sealed this

Thirteenth Day of July 1976

[SEAL]

*Attest:*

RUTH C. MASON
*Attesting Officer*

C. MARSHALL DANN
*Commissioner of Patents and Trademarks*